US006075459A

United States Patent [19]

Saarem et al.

[11] Patent Number: 6,075,459

[45] Date of Patent: Jun. 13, 2000

[54] REMOTE STARTER FOR A COMBUSTION ENGINE/ELECTRIC GENERATOR SET

[76] Inventors: Myrl J. Saarem, 2057 W. Washington St., Carson City, Nev. 89703; Clayton D. Foster, 561 Mark Way, Carson City, Nev. 89706

[21] Appl. No.: 09/088,257

[22] Filed: Jun. 1, 1998

[51] Int. Cl.[7] ..... G08C 19/00; F02N 17/00

[52] U.S. Cl. ..... 340/825.69; 123/179.2; 123/179.3; 123/179.4

[58] Field of Search ..... 123/179.2, 179.3, 123/179.4; 340/825.69, 825.72, 825.67; 290/30 R, 30 A, 30 B

[56] References Cited

U.S. PATENT DOCUMENTS

| | | | |
|---|---|---|---|
| 3,553,472 | 1/1971 | Arlandson | 290/38 |
| 4,577,599 | 3/1986 | Chmielewski | 123/179 |
| 5,601,058 | 2/1997 | Dyches | 123/179.2 |

*Primary Examiner*—Michael Horabik
*Assistant Examiner*—Alton Hornsby, III

[57] ABSTRACT

Remote starting of an internal combustion engine/electric generator set is obtained by sensing a connected appliance switch closure over the cord connecting the appliance to the generator and starting the combustion engine in response to that closure. After the engine is started the appliance is connected to the generator. After a predetermined time of nonuse of the appliance the combustion engine is stopped.

8 Claims, 4 Drawing Sheets

REMOTE STARTER FOR A COMBUSTION ENGINE/ELECTRIC GENERATOR SET

BACKGROUND—FIELD OF THE INVENTION

This invention relates to remote starting of a combustion engine of a combustion engine/electric generator set. Further, this invention utilizes the conductors that connect the appliance (load) to the generator as the transport of signal to initiate the start of the engine.

BACKGROUND—DESCRIPTION OF PRIOR ART

This invention finds utility in the building industry, as an example. Electric power many times is not available through conventional power distribution systems. The builder may then resort to the use of a combustion engine/electric generator set to supply electric power to electric appliance loads such as electric saws, electric drills, and electric sanders, for example. Situations may arise where, a carpenter on a roof, deciding to use an electric saw, may have to descend from the roof to start the engine and return to the roof to perform his sawing function. Thereafter, the engine/generator set may remain running for long periods of time, even though no appliance load is being used.

This invention allows the carpenter on the roof to depress the "power on" switch on an appliance load, which starts the combustion engine by logic contained in a control. Thus, the logic to effect engine starting is conducted over the power cord that connects the appliance load to the generator. After the engine has started the control disconnects the starting circuit and connects the appliance load to the generated electric power at the output of the generator. After a predetermined period of nonuse of the connected appliance load (s), the control turns the engine/generator set off.

Inventors have patented many systems for remotely starting combustion engines, such as RE30,686, U.S. Pat. Nos. 4,080,537, 4,227,588, 4,236,594, 4,345,554, 4,392,059, 4,446,460, 4,598,209, 4,674,454, 5,000,139, 5,054,569, and 5,673,017. These all relate to motor vehicles and/or automobiles.

U.S. Pat. No. 5,601,058 relates to the energizing and de-energizing of a starter motor depending on certain criteria derived from the combustion engine.

U.S. Pat. No. 4,577,599 relates to remotely starting a two cycle internal combustion engine and controlling certain engine adjustments to accommodate varying environmental conditions.

None of these cited patents recite the use of the conductors of the power cord that supplies power to the appliance load as being used to transmit engine starting logic.

OBJECTS AND ADVANTAGES

Several objects and advantages of this invention are:

(a) to provide a convenient way to remotely start an engine/generator set (b) to provide an inexpensive remote start system for an engine/generator set (c) to utilize the power cord conductors from the appliance load to the generator, additionally, for starting the engine of the engine/generator set, and (d) to provide for efficiently stopping of the engine/generator set when it is not in use.

DRAWING FIGURES

DESCRIPTION OF THE INVENTION

Figure 1:
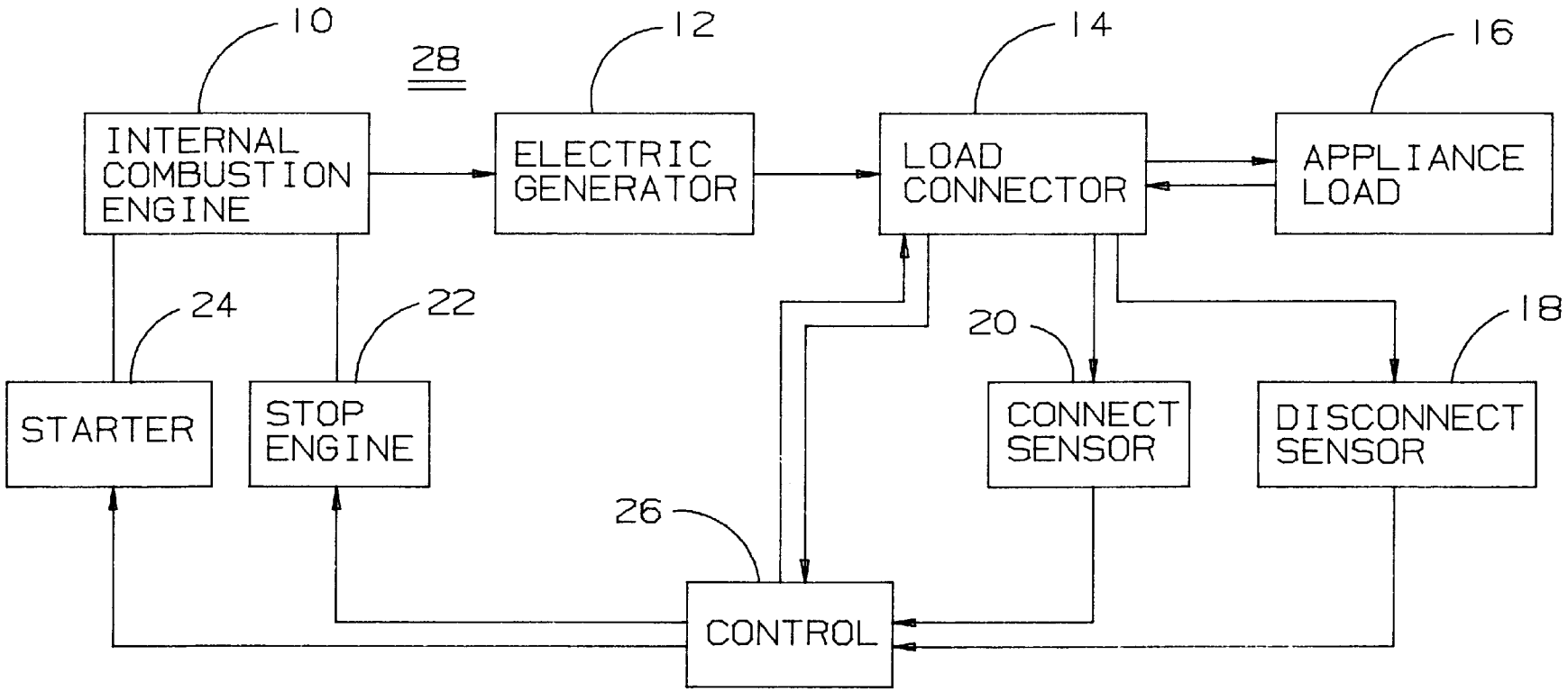
FIG. 1 shows a block diagram of the separate components of the invention.

FIG. 1 shows an embodiment of the invention. Internal combustion engine 10 is drivingly connected to electric generator 12, forming an engine/generator set 28. An appliance load(s) 16 may be connected to the generator 12 through a load connector 14. The load connector 14 connects either the appliance load 16 to the control 26, or the appliance load 16 to the generator 12, but not both at the same time.

Control 26 processes sensor information to perform various logic functions as will be described.

A connect sensor 20 is provided to sense when the generator 12, during the start cycle, has attained sufficient speed to supply sufficient electric power to the appliance load 16. This is also an indication that the engine 10 will maintain a running condition when the appliance load electrical load is connected to the generator 12. Disconnect sensor 18 is provided to sense when no current is being drawn from the generator 12, such as when no appliance load(s) 16 is in use.

Figure 2A:
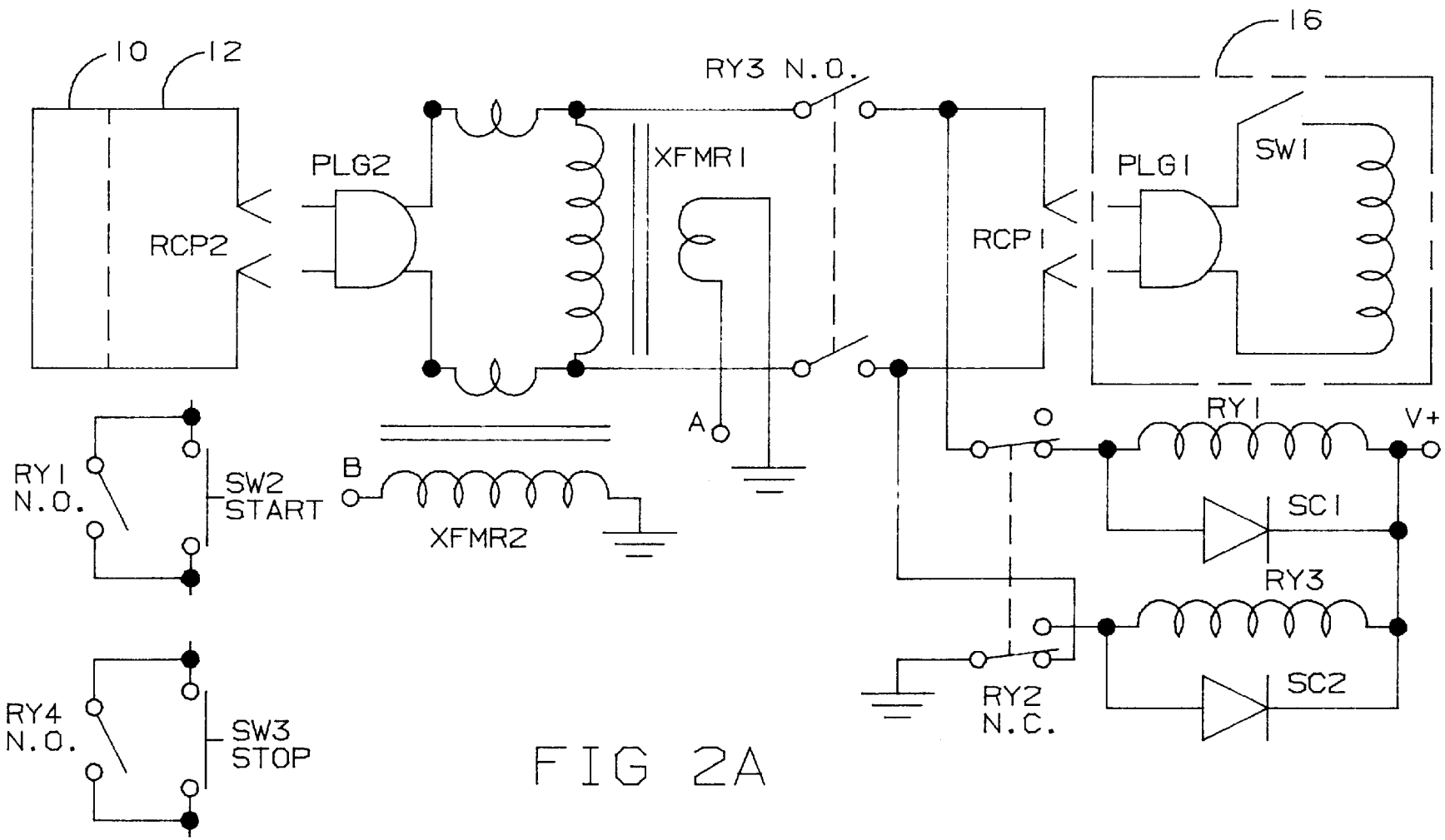
FIGS. 2A, 2B and 2C are an electrical/electronic circuit diagrams showing the electrical connections of the invention.
Figure 2B:
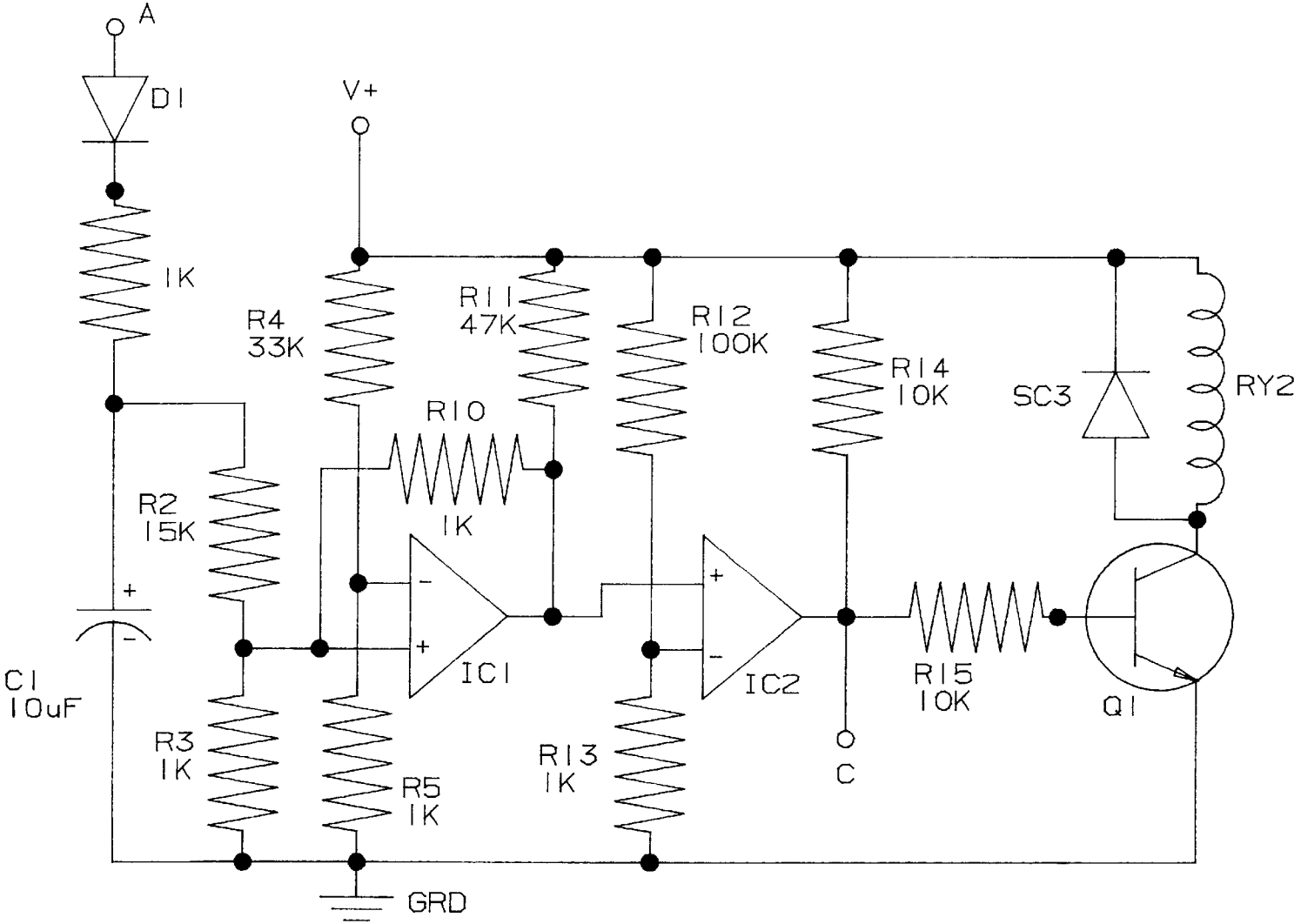
Figure 2C:
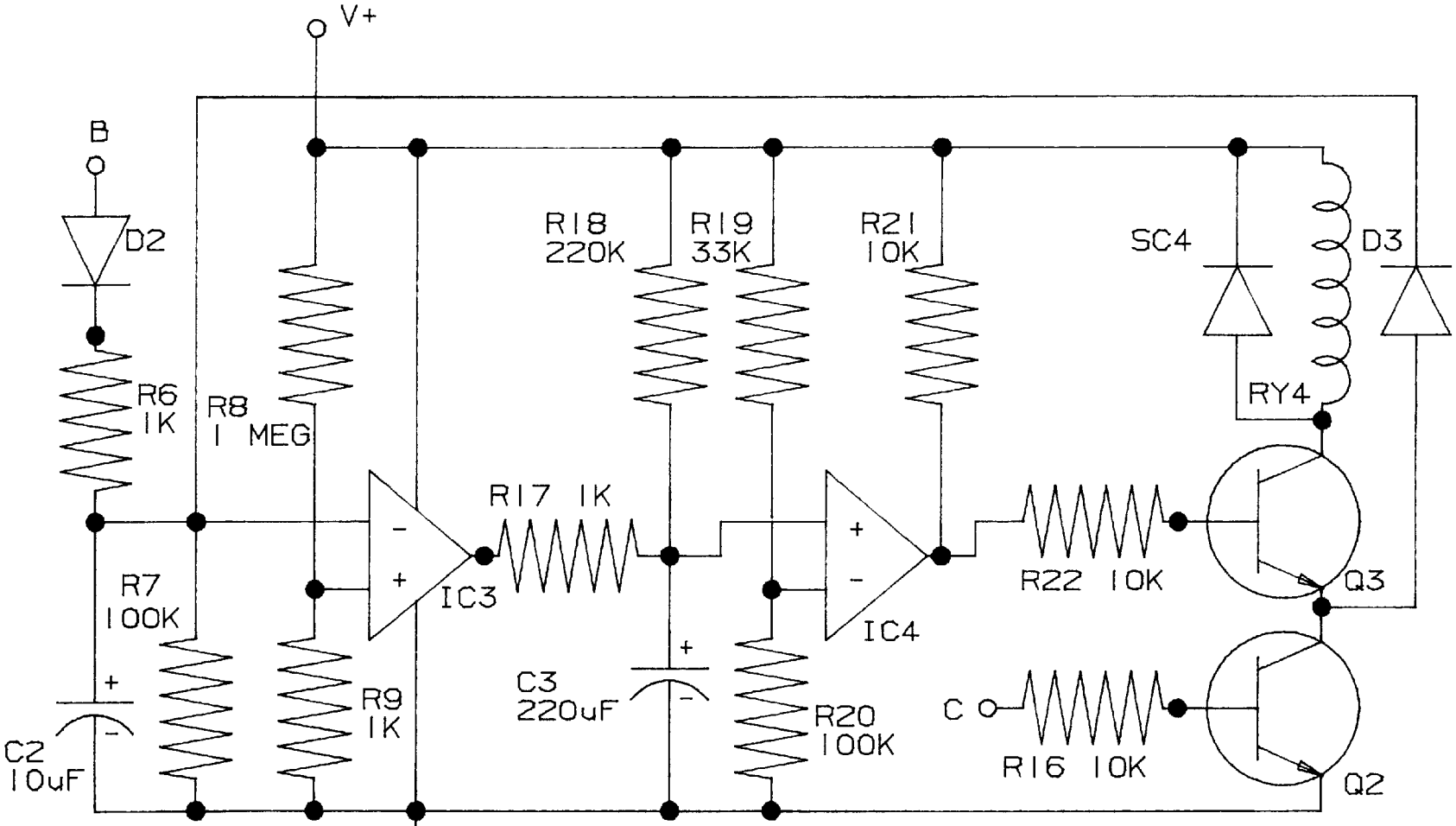

In FIG. 2, appliance load 16 is plugged into load connector 14 by inserting plug PLG1 in receptacle RPC1. Load connector 14 is plugged into generator 12 by insertion of plug PLG2 into receptacle RPC2. When switch SW1 of appliance load 16 is closed the coil of relay RY1 is energized. This causes closure of the relay contacts RY1 N.O. which jumpers manual start switch SW2 and energizes the starter 22 (See FIG. 1) of the combustion engine 10.

The connect sensor 20 consists of transformer XFMR1.

The output of transformer XFMR1 is received by control 26 through diode D1, resistors R1, R2 and R3 and capacitor C1. Diode D1 serves to half wave rectify the AC voltage from the transformer XFMR1 and resistor R1 and capacitor C1 act as a filter. Resistors R2 and R3, connected in series to ground GRD, divide the resulting DC voltage. The node between R2 and R3 is joined to the positive input terminal of a voltage comparator IC1 (which would typically be ¼ of a quad comparator such as LM339).

Resistors R4 and R5 are connected in series from engine battery voltage V+ to system ground GRD. The node between resistors R4 and R5 is connected to the negative terminal of the voltage comparator IC1 to set a switching voltage threshold of the comparator. Resistor R11 provides a limit to the current that can flow from V+ through comparator IC1 to ground GRD and cooperates with resistor R10 to provide feedback after switching to reset the threshold voltage at the positive input of comparator IC1. The output of comparator IC1 will switch to a "high" state when the generator 12 output reaches a predetermined level on increasing voltage. The output of comparator IC1 will go to a "low" state when the generator 12 output reaches a predetermined level on decreasing voltage. The comparator IC1 latches in a "high" output state between these predetermined generator 12 output voltages.

The output of the comparator IC1 is fed to the positive input of comparator IC2. Resistors R12 and R13 form a voltage divider between V+ and ground GRD. The node between R12 and R13 is connected to the negative terminal of IC2 and this sets the switching threshold of comparator IC2. Resistor R14 acts to limit the current through comparator IC2. Resistor R15 supplies bias to the base of transistor Q1. When the output of comparator IC1 is "high" the output of comparator IC2 is also "high" and transistor Q1 is biased to act as a closed switch, which allows current to flow through relay RY2.

When current flows through relay RY2, its contacts switch from normally closed to normally open and relay RY1 is de-energized and, momentarily, relay RY3 is energized. Appliance load 16 is no longer connected to any of the V+ battery circuit, but is instead connected to the AC output of the generator 12.

Once this connection of the appliance load 16 to the generator 12 is made through the load connector 14, and if the appliance load 16 is drawing current, such as the appliance load is in use, the current sensor 20 senses a current.

The current sensor 20 consists of transformer XFMR2.

The output of XFMR2 is received by control 26 through diode D2, resistors R6 and R7, and capacitor C2. Diode D2 serves to halfwave rectify the output from transformer XFMR2. Resistor R6 and capacitor C2 act as a filter. One end of resistor R7 is connected to the node of resistor R6 and capacitor C2 and also the negative input of IC3. The other end of resistor R7 is connected to ground, as is the remaining end of C2.

Resistors R8 and R9 form a voltage divider from battery voltage V+ to ground GRD. The center node between these resistors is connected to the positive input of the comparator IC3 to set a switching voltage threshold. The connection shown from V+ to comparator IC3 and from ground GRD to comparator IC3 also provides like connections to comparators IC1, IC2, and IC4.

Resistor R18 and capacitor C3 are connected in series between V+ and ground GRD. Resistor R17 is connected from the output of IC3 to the node between resistor R18 and C3.

When current is detected by the current sensor 20 the output of comparator IC3 is at a "low" state. The value of resistor R17 is small compared to resistor R18 and therefore the positive terminal of comparator C3 is very near ground potential when the output of comparator IC3 is "low".

When no current is detected by the current sensor 20 the output of comparator IC3 switches to a "high" level. The voltage on the positive terminal of capacitor C3 starts to increase by virtue of current flowing through resistor R18. As will be described, resistor R18 and capacitor C3 act cooperatively to create a time delay.

Resistors R19 and R20 are connected in series between V+ and ground GRD. The node between resistors R19 and R20 is connected to the negative terminal of comparator IC4 to set a voltage switching threshold.

After a predetermined time the voltage at the positive terminal of capacitor C3 exceeds the threshold voltage at the negative terminal of comparator IC4. The output of comparator IC4 then switches to a "high" state.

Resistor R21 is connected from V+ to the output of comparator IC4 acts as a current limiter. Resistor R22 is connected from the output of comparator IC4 to the base of transistor Q3. The coil of relay RY4 is connected to V+ and to the collector or transistor Q3. The emitter of transistor Q3 is connected to the collector of transistor Q2. The emitter of transistor Q2 is connected to ground GRD.

When the output of comparator IC4 is "high" transistor Q3 is biased to act as a closed switch and current will flow through relay RY4, provided transistor Q2 is also biased as a closed switch (the function of transistor Q2 will be described later). The normally open contacts of relay RY4 N.O. are then closed and the manual stop switch SW3 is jumpered and the stop engine 24 is activated and the engine slows and eventually stops.

As the engine stops the input voltage to comparator IC1 drops to a level that causes the comparator IC1 output to switch to a "low" state. Transistor Q1 ceases to be biased for conduction and current stops flowing in relay RY2. The contacts of relay RY2 switch back to the normally closed state, relay RY3 is no longer energized, the contacts of relay RY3 open, and therefore, the appliance load 16 is disconnected from the generator 12.

Diode D3 is connected from the collector of transistor Q2 to the negative input of comparator IC3. Transistor Q2 acts as a switch to ground GRD only if the output of comparator IC2 is "high", such as the normally open contacts of relay RY3 are closed and the appliance load 16 is connected to the generator 12 through load connector 14. This provides the logic that relay RY2 must be energized before RY4 can be energized. If the output of comparator IC2 is "low", the collector of transistor Q2 is "high". This higher voltage is fed back to the negative input of comparator IC3 through diode D3 and this causes the output of comparator IC3 to be "low", which in turn causes the positive terminal of timing capacitor C3 to be held near ground GRD potential. Transistor Q2 must act as a closed switch before timing can begin.

Rectifiers SC1, SC2, SC3, and SC4 are used as suppression devices for inductive loads.

It is obvious that the majority of the electronic components described in this specification can be integrated into a micro-processor and greatly decrease the number of parts required.

The invention can take the form of an accessory to an engine/generator set; such as, one could plug the accessory into the generator and plug the appliance load into the accessory, or the invention can be totally contained within the engine/generator set as part of the original equipment.

Operation

Remotely located from an engine/generator set, the user closes the switch on his/her connected appliance load and the engine/generator starts. If, after a predetermined time, there has been no use of any connected appliance load the engine/generator will stop.

What is claimed is:

1. A combustion engine/generator set comprising:

a) a combustion engine b) an electric generator c) said combustion engine drivingly coupled to said electric generator d) means for remotely starting said combustion engine by logic transmitted through an electrical appliance load electrically connected to said generator.

2. A combustion engine/generator set comprising:

a) a combustion engine b) an electric generator c) said combustion engine drivingly coupled to said electric generator d) means for electrically connecting an appliance load(s) to said electric generator e) said appliance load(s) having a switch for allowing operation of said appliance load f) means for remotely starting said combustion engine by closing said switch on said appliance load.

3. If The combustion engine/generator set of claim 2 wherein said closing of said switch of said appliance load is sensed by a control means and said control means causes a) said combustion engine to start, and after starting b) said appliance load to disconnect from said control means, and c) said appliance load to connect to said generator.

4. The combustion engine/generator set of claim 3 wherein the sensing of closure of said switch is transmitted through the cord connecting said appliance load to said control.

5. The combustion engine/generator set of claim 3 wherein the said control is principally an integrated circuit microprocessor.

6. A combustion engine/generator set comprising:

a) a combustion engine b) an electric generator c) said combustion engine drivingly coupled to said electric generator d) means for electrically connecting an appliance load(s) to said electric generator e) means for stopping said combustion engine after a predetermined time of nonuse of said appliance load(s).

7. The combustion engine/generator set of claim 6 wherein the said stopping means senses when no electric current is being drawn by the said appliance load as sensed by a control and after a predetermined time said control causes a) said combustion engine to stop, and b) said appliance load to be disconnected from said generator.

8. The combustion engine/generator set of claim 6 wherein the said control is principally an integrated circuit microprocessor.

* * * * *